US006668907B1

(12) United States Patent
Nuetzel et al.

(10) Patent No.: US 6,668,907 B1
(45) Date of Patent: Dec. 30, 2003

(54) CASTING WHEEL PRODUCED BY CENTRIFUGAL CASTING

(75) Inventors: Dieter Nuetzel, Bruchkoebel (DE); Ewald Grote, Glauberg (DE); Giselher Herzer, Bruchkoebel (DE)

(73) Assignee: Vacuumschmelze GmbH, Hanau (DE)

( * ) Notice: Subject to any disclaimer, the term of this patent is extended or adjusted under 35 U.S.C. 154(b) by 0 days.

(21) Appl. No.: 09/958,255

(22) PCT Filed: Jun. 21, 2000

(86) PCT No.: PCT/EP00/05781

§ 371 (c)(1),
(2), (4) Date: Jan. 17, 2002

(87) PCT Pub. No.: WO01/00354

PCT Pub. Date: Jan. 4, 2001

(30) Foreign Application Priority Data

Jun. 23, 1999 (DE) ..... 199 28 777

(51) Int. Cl.[7] ..... B22D 11/06
(52) U.S. Cl. ..... 164/423; 164/463; 164/122.1
(58) Field of Search ..... 164/423, 428, 164/429, 463, 479, 480, 122.1

(56) References Cited

U.S. PATENT DOCUMENTS 4,142,571 A * 3/1979 Narasimhan ..... 164/463
4,307,771 A * 12/1981 Draizen et al. ..... 164/463
4,537,239 A * 8/1985 Budzyn et al. ..... 164/423
5,564,490 A * 10/1996 Liebermann et al. ..... 164/463
5,842,511 A * 12/1998 Raybould et al. ..... 164/423

FOREIGN PATENT DOCUMENTS

| | | | | |
|---|---|---|---|---|
| EP | 0 024 506 | * | 3/1981 | B22D/11/04 |
| EP | WO 9633828 | | 10/1996 | B22D/11/06 |
| EP | WO 9807535 | | 2/1998 | B22D/11/06 |
| JP | 62-97748 | * | 5/1987 | B22D/11/06 |

OTHER PUBLICATIONS

Abstract of Japanese Patent Document No. 62 097748 (May 7, 1987).

Abstract of Japanese Patent Document No. 57 139543 (Aug. 28, 1982).

* cited by examiner

*Primary Examiner*—M. Alexandra Elve
*Assistant Examiner*—Kevin P. Kerns
(74) *Attorney, Agent, or Firm*—Dean W. Russell; Kilpatrick Stockton LLP

(57) ABSTRACT

The invention relates to novel casting wheels for the rapid solidification technique which are produced by centrifugal casting. The wheels are made of an alloy with a non-equiaxial granular structure, wherein the grains are elongated and their longitudinal axis lies substantially perpendicular to the casting-wheel surface.

13 Claims, 3 Drawing Sheets

CASTING WHEEL PRODUCED BY CENTRIFUGAL CASTING

This application claims priority to German Application No. 199 28 777.5 filed on Jun. 23, 1999 and International Application Publication Number WO/01 00354 A1 filed on Jun. 21, 2000.

BACKGROUND OF THE INVENTION

The commercially most significant process for the production of amorphous and/or microcrystalline materials in the form of ribbons, wires, or foils is the rapid solidification of melted metal via melt-spinning processes. In this production process, a melted metal is sprayed through a nozzle onto a casting roller, casting rim, or casting drum which is rotating at speeds of up to 30 m/s. In so doing, the melt cools at a rate of cooling between $10^4$–$10^6$ K/s, solidifies on the casting surface to form a continuous ribbon, and is separated from the casting roller. In U.S. Pat. No. 4,142,571, an apparatus of this type for the production of metallic thin ribbons is described.

In the production process described for metal ribbons or foils the following problems or requirements for the casting wheel material arise:

a) The casting wheel material must have a sufficiently high thermal conductivity in order to discharge the heat being released during the solidification of the melt or during the further cooling of the solidified ribbon, wire, or foil. If this is not the case then, for example, the following problems can arise: sparking, no formation of ribbons, the strived-for microstructure of the metal foil to be produced, and thus its strived-for properties, not being achieved (for example, poor magnetic properties of amorphous foils due to partial crystallization), and/or the ribbon produced being brittle and thus mechanically not further processible.

b) The casting wheel material must be highly resistant to thermal as well as mechanical stress since the surface of the casting wheel is exposed to significant wear through its interaction with the melt or with the solidified ribbon. The occurrence of wear is expressed in a poor quality of the ribbon produced, such as, for example, holes, rough surfaces, and so on. These mechanical defects affect the mechanical and magnetic properties of the produced ribbon sensitively. The wear of the casting wheel furthermore leads to a poor thermal contact between casting wheel and ribbon or to a poor spreading of the melted metal on the casting wheel. Thus the rate of cooling of the ribbon is reduced which brings on the problems already cited under a). The constellation of problems of casting wheel wear just described occurs in particular with longer casting times and worsens with increasing casting time until finally proper ribbon formation is no longer possible.

SUMMARY OF THE INVENTION

It is thus one objective of the invention to find a material whose use as casting wheel material makes possible the problem-free production of amorphous or microcrystalline, qualitatively high-value metal alloys, in particular in large commercial amounts and which minimizes the problems described above.

DETAILED DESCRIPTION

Figure 1:
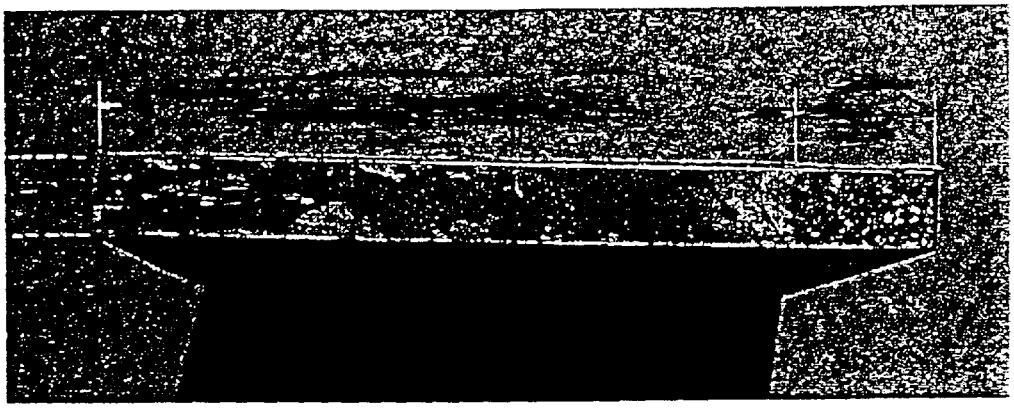
FIGS. 1, 2, and 3 illustrate metallurgic photographs of surface patterns of casting wheel materials.

For the reduction of wear of the casting wheels, which is determined to a considerable extent by the cyclic thermal stress during the casting process, they must have a sufficient mechanical hardness and strength as well as resistance to fatigue. In order to achieve the high rates of cooling which are necessary for the production of materials with amorphous microstructure, a uniformly high thermal conductivity of the casting wheels is furthermore required.

The high thermal conductivity and the high strength of the casting wheel materials cannot be developed independently of one another in this case. As a rule an increase of the hardness, which has a positive effect on the wear behavior of the casting wheels, leads to a reduction of the thermal conductivity. This brings with it problems for the casting of sensitive amorphous alloys.

The high thermal conductivity is achieved in this case by the use of highly thermally conductive steels, coppers, or copper alloys. In this case, quick-hardenable and dispersion-hardened copper alloys as well as Cu—Be bronzes come into use along with oxygen-free copper.

Along with the choice of material and an optimization of the material properties, the casting wheels can be provided with suitable coatings (see European Patent No. EP 0 024 506) in order to improve their wear behavior during the casting process.

A fine-grain composite of the casting wheel materials has proven itself in developing a high mechanical strength in connection with a high thermal conductivity (see FIG. 1), which has a favorable effect on the casting properties, in particular in relation to wear and lifetime of the casting wheel. Such composites can be realized by a reforming process (as a rule hot or cold forging or ring rolling) in connection with a heat treatment. Casting wheels for rapid solidification are thus as a rule first of all cut from cast blocks and reformed with various forging (free-form forging, drop forging) or other reforming process (for example, ring rolling). For forging and heat treatment processes of this type for casting wheel materials various process patents already exist: In JP 62-097 748 a composite with a grain size<1000 $\mu$m has been developed, for example, in a cast Cu—Cr—Zr casting wheel through a certain heat treatment which prevents the formation of large grains.

In WO 96/33828 composites as well as forging and annealing processes for casting rollers are described with which a uniform grain size <1000 $\mu$m can be developed in order to achieve sufficient hardness and resistance to wear in connection with high thermal conductivity.

In WO 98/07535 a grain size <500 $\mu$m in connection with a equiaxial grain geometry has been developed by forging variations in order to adapt the casting wheels to the profile of requirements (high strength, resistance to wear, high thermal conductivity). The wear and the lifetime of the casting wheels can be further improved by the grain geometry. Along with the contribution to the precipitation hardening, the strength according to the Hall-Petch equation is increased by this grain refinement (cf., for example, Gr äfen, H.: VDI-Lexikon Werkstofrtechnik [Association of German Engineers' Encyclopedia of Materials Technology], VID Verlag, Düsseldorf 1993].

Despite these numerous efforts, casting wheels produced according to the state of the art do not solve the constellation of problems described above in the production of ribbons in a satisfactory manner.

In the case of these forged and heat-treated casting wheels, various problems still occur.

In practice, it has nonetheless proven itself difficult, as a rule, to produce the homogeneous and fine grain structure recognized as favorable. Thus an inhomogeneous composite structure, wherein very coarse grains are present along with small grains, can arise in the casting wheels through a non-uniform deformation during the forging process. This leads to an increased and inhomogeneous wear of the surface of the casting wheel when used. During the casting process, surface cracks are formed predominantly at these inhomogeneities or in part complete grains are torn out of the substrate material. The casting wheels must thus be reworked after a relatively short operating time for the purpose of eliminating the surface defects. The casting process must be interrupted for the reworking. On reworking (turning outside diameter) of the casting wheel, the problem can result in this case that the grain structure becomes inhomogeneous and/or coarser whereby the wear behavior deteriorates. This problem is linked to the production technology of conventional wheels which ultimately can guarantee a reproducible composite structure only at the surface.

Furthermore, areas on the surface of the casting wheel with different thermal conductivity can arise due to the partially inhomogeneous composite structure over the circumference of the forged casting wheels. This leads in the case of amorphous alloys, which have a very sensitive casting behavior (for example, $Fe_{73.5}Cu_1Nb_3Si_{13.5}B_9$) to undesired occurrences of brittleness due to locally delayed cooling of the melt. Thus, these amorphous thin ribbons are no longer suitable for further processing.

Along with the problems in the casting process, additional difficulties arise in the production of forged casting wheels of this type.

On heating up of larger parts for hot forging (casting wheels have diameters up to 1.2 m), stress fractures in the material can arise whereby the casting ring is completely destroyed. Moreover, long heat-up times have to be applied in the case of large structural parts in order to achieve a uniform heating throughout and therewith homogeneous deformation. In the case of certain modes of construction of the casting wheels, in which a ring of the highly thermally conductive alloy is shrunk onto a steel or aluminum hub, cracks or separation of material can arise during the shrinking process due to the inhomogeneous composite structure or other forging faults, whereby the casting wheel also cannot be used.

The production of the forged casting wheels according to the state of the art is very cost-intensive and demanding of apparatus due to the difficulties presented. Due to the production problems, only a few firms are in the position to produce casting wheels of this type with the requirement profile necessary for rapid solidification or to guarantee a consistently uniform quality of the casting wheels. Their acquisition is thus difficult and expensive.

It has been shown that the objective initially described can be realized in a particularly advantageous manner by the use of a casting roller material which has non-equiaxial, longitudinally extended crystal grains whose long axis is oriented in the radial direction of the casting wheel. This texturized grain zone prevents a breaking out of entire grains from the surface of the casting wheel since the grains are firmly anchored in the surface of the casting wheel by their longitudinal structure.

Furthermore, the longitudinal structure of the grains favors the discharge of heat from the surface of the casting wheel. A composite structure textured in this manner furthermore favors the formation of a uniform grain structure in the radial direction as well as in the circumferential direction. Thus no local nests of wear arise over the circumference which affect the ribbon quality locally. Furthermore, the uniformly fine composite structure also continues to exist after the reworking of the casting wheel (turning outside diameter).

Casting wheels with a composite structure of this type can be realized via a centrifugal casting process. In this production process the melt is solidified under the action of a very high radial acceleration (up to 120 times gravitational acceleration). By the pressure arising, a strong degassing of the melt occurs whereby all the impurities of the liquid melt are prevented. Through this solidification property a very pure, highly densified composite arises which already has very favorable mechanical properties in the cast state. The centrifugally cast components distinguish themselves moreover by a very homogeneous, finely structured cast composite which is free of intrusions, bubbles, and cavities. This cast composite, which is, above all at the surface, very homogeneous, reduces in addition the occurrence of wear and is thus an additional feature of our invention.

Through the uniform, directed solidification from the mold wall to the hole, the directed grain composite, favorable for the casting process, arises, in which composite the longitudinal grains are oriented in the radial direction. This very homogeneous composite structure causes a uniformly low wear over the entire circumference of the casting wheel and provides therewith a contribution to the reliability of the process of rapid solidification. By this composite structure the grains are furthermore firmly anchored in the surface of the casting wheel and the breaking out of complete grains, as can be observed in the case of forged casting wheels, no longer occurs in composites of this type.

Restricted by the very uniform composite structure no undesired variations in the thermal conductivity occur over the circumference of the casting wheel whereby sensitive, amorphous alloys can be cast with a higher process reliability and improved quality (ductility). The grain geometry and grain orientation in the radial direction moreover are associated with an accelerated heat discharge from the surface of the casting wheel, which brings with it significant advantages for the rapid solidification of melted metals.

Along with the advantages of the composite structure the cost-intensive reforming and forging processes are eliminated by the near-final-form forming with centrifugal casting, with which rotationally symmetric cast parts up to 6000 mm in diameter can be produced. This leads to a significant reduction of the production expense and therewith very favorable production costs.

Moreover, the production and availability difficulties described previously no longer exist. The invention is described in the following with the aid of an exemplary embodiment and with the aid of three figures.

The composite of a centrifugally cast casting wheel with the use of a Cu—Cr—Zr alloy is composed of a near-surface, fine-grain zone with a depth of up to ca. 15 mm with a grain size between 100 and 2000 $\mu$m and an adjacent stem crystal zone which has grains oriented in the radial direction with a grain size between ca. 1000 $\mu$m and 6000 $\mu$m.

Figure 2:
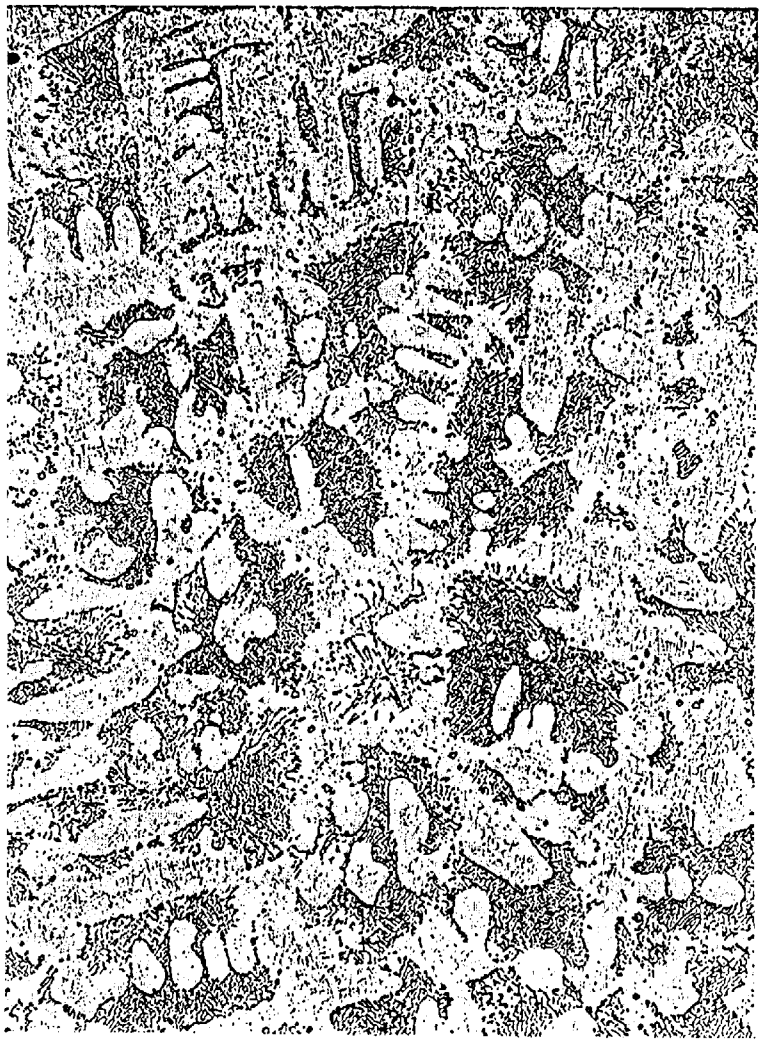

The grains are penetrated, in the near-surface, fine-grain zone as well as in the adjacent stem crystal zone, with so-called dendrites, which is represented in FIG. 2. This is characteristic for casting composites that are not further reformed. These dendrites lead to a mechanical reinforcement of the cast composite. Through this mechanical reinforcement of the casting composite the very good casting properties cited in the introduction to the description are decisively achieved for the casting wheels centrifugally cast according to the invention.

Figure 3:
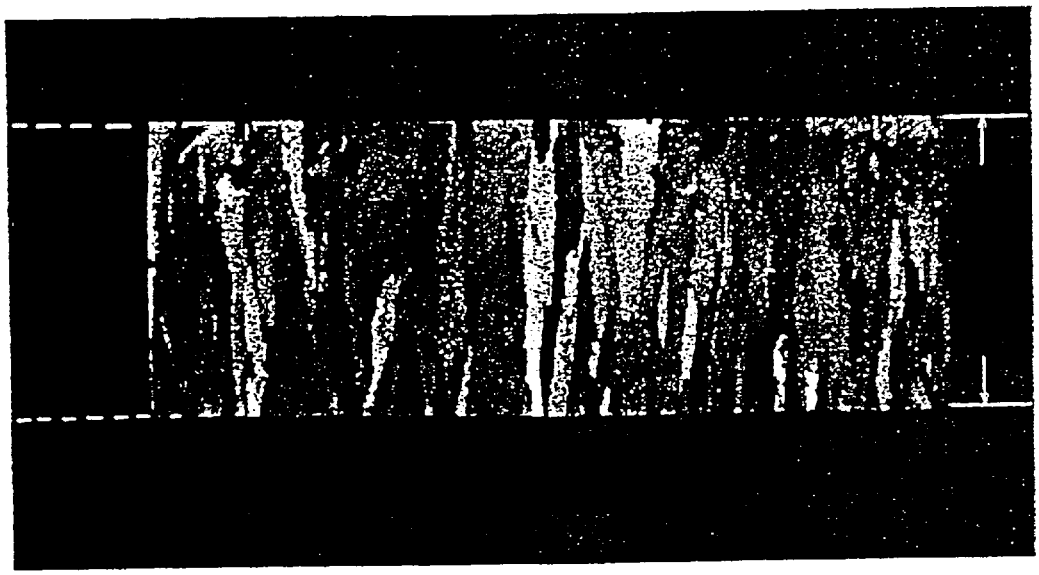

In FIG. 3, a section of a cast composite of a Cu—Cr—Zr casting wheel material is shown once again. Therein the grains oriented in the radial direction with longitudinally extended grain geometry are once again clearly recognizable.

It is noted that the photographs of ground surface patterns of Cu—Cr—Zr casting wheel materials shown in FIGS. 1, 2, and 3 merely serve to illustrate a single casting wheel material. Images and metallurgic pictures of Cu—Ni—Si casting wheel materials as well as Cu—Be bronzes show similar casting composites which also have the typical dendrites.

What is claimed is:

1. A rotationally symmetric casting wheel having a quench surface, said casting wheel operable for the production of amorphous and/or microcrystalline metal ribbons by rapid solidification, said casting wheel comprising a thermally conducting centrifugal casted alloy with a texturized grain zone comprising non-equiaxial grains that are longitudinally extended, each of which has a long axis, with a substantial portion of the long axis oriented essentially perpendicular to the quench surface of the casting wheel.

2. The casting wheel according to claim 1, wherein the extension of the individual grains essentially perpendicular to the surface of the casting wheel is at least twice as large as their extension in the surface of the casting wheel.

3. The casting wheel according to claim 1, wherein the grain size is homogeneous over the circumference of the casting wheel.

4. The casting wheel according to claim 1, wherein the grain size is smaller than 500 $\mu$m at the surface of the casting wheel.

5. The casting wheel according to claim 4, wherein the grain size is smaller than 200 $\mu$m at the surface of the casting wheel.

6. The casting wheel according to claim 5, wherein the grain size is smaller than 100 $\mu$m at the surface of the casting wheel.

7. The casting wheel according to claim 1, comprising a high thermal conductivity.

8. The casting wheel according to claim 1, comprising a Cu—Cr—Zr alloy.

9. The casting wheel according to claim 1, comprising a Cu—Ni—Si alloy.

10. The casting wheel according to claim 1, comprising a Cu—Be bronze.

11. The casting wheel according to claim 1, comprising a diameter of at least 300 mm.

12. The casting wheel according to claim 1, wherein the casting wheel is shrunk in the form of a ring onto a hub.

13. The casting wheel according to claim 1, further comprising cooling holes, through which a liquid flows.

* * * * *